US007269918B2

(12) United States Patent
Merlino

(10) Patent No.: US 7,269,918 B2
(45) Date of Patent: Sep. 18, 2007

(54) PUMP GUN

(75) Inventor: Giacomo Merlino, Gardone V.T. (IT)

(73) Assignee: A. Uberti S.p.A. (IT)

( * ) Notice: Subject to any disclaimer, the term of this patent is extended or adjusted under 35 U.S.C. 154(b) by 26 days.

(21) Appl. No.: 11/186,516

(22) Filed: Jul. 21, 2005

(65) Prior Publication Data

US 2007/0089346 A1 Apr. 26, 2007

(30) Foreign Application Priority Data

Jan. 26, 2005 (IT) ..... BS2005A000005

(51) Int. Cl.
*F41C 13/00* (2006.01)
*F41C 11/00* (2006.01)

(52) U.S. Cl. ..... 42/17; 42/14; 42/69.02; 42/16; 42/21

(58) Field of Classification Search ..... 42/21, 42/2, 17, 14, 69.02, 40
See application file for complete search history.

(56) References Cited

U.S. PATENT DOCUMENTS 278,324 A 5/1883 Elliot
1,481,042 A * 1/1924 Walther et al. ..... 42/17

* cited by examiner

*Primary Examiner*—Peter M. Poon
*Assistant Examiner*—John D. Holman
(74) *Attorney, Agent, or Firm*—McGlew and Tuttle P.C.

(57) ABSTRACT

A pump gun is disclosed having a loading and firing mechanism which comprises a cartridge stop lever (21), that is not connected to the hammer, interacts with the cocking slide (22) associated with the cartridge magazine and is susceptible to rocking movements on an intermediate pin (30) between an operating interception position of a first cartridge in the magazine, when the cocking slide is in a retracted work position, and an idle release position of the same cartridge from the magazine tube, when the cocking slide is in the forward rest position.

9 Claims, 8 Drawing Sheets

18
10a
14
13
23
10
11
21
20
40
34
13
22

PUMP GUN

FIELD OF THE INVENTION

This invention concerns improvements on a pump gun of the type disclosed, for example, in U.S. Pat. No. 278,324 in the name of W. H. Elliot and produced by Colt.

STATE OF THE ART

The gun taken into consideration comprises mainly a barrel with a cartridge chamber, a cartridge magazine tube arranged under and parallel to the barrel, a carrier made to receive a cartridge from the magazine tube and to carry it up to the cartridge chamber, a breech block moving between a retracted open position and a forward closed position of the cartridge chamber, a firing pin on board of said breech block, a hammer associated with a control trigger and turning between a cocked and a firing position on said firing pin, a breech block retaining lever in a retracted position, a cocking slide moving between a forward rest position and a retracted work position to produce the movements of the breech block, the rotation of the hammer in the cocked position and the transfer of a cartridge from the magazine tube to the carrier to send it to the cartridge chamber following a successive forward movement of the breech block, and a closing lever associated with the cocking slide and designed to lock the breech block in the forward closed position of the cartridge chamber.

However in such a gun, the components of the loading mechanism of a cartridge into the cartridge chamber, cocking hammer and firing are all connected to and depend on the hammer. So, in particular, when for various reasons the cartridges require to be removed from the magazine to prevent the gun being used, and so as not to have to fire each individual cartridge until the magazine is empty, the hammer has to be cocked and released each time, taking care to accompany it carefully against the rear of the breach block so that it does not strike the firing pin. In this way however the risk of accidentally or however inadvertently firing a cartridge cannot be excluded.

OBJECTS OF THE INVENTION

One objective of this invention is to avoid such a risk and therefore to enable the cartridges to be unloaded from the pump gun without necessarily having to use the hammer.

Another aim of the invention is to propose a pump gun like the one referred to above, but with some of its components improved, to facilitate loading of each cartridge into the barrel and for a more reliable and safe use of the gun itself.

These objectives and implicit advantages which derive from them are achieved, according to the invention, with an unloadable pump gun in compliance with the preamble of claim 1 and characterized by a longitudinally stationary cartridge stop lever, interacting with said cocking slide and susceptible to rocking movements on an intermediate pin between an operating interception position of a first cartridge in the magazine when the cocking slide is in the retracted position and an idle release position of the same cartridge from the magazine when the cocking slide is in the forward position.

BRIEF DESCRIPTION OF THE DRAWINGS

The invention will however be explained more in detail in the continuation of this description made in reference to the enclosed diagrammatic drawings, in which.

DETAILED DESCRIPTION OF THE INVENTION

Figure 1:
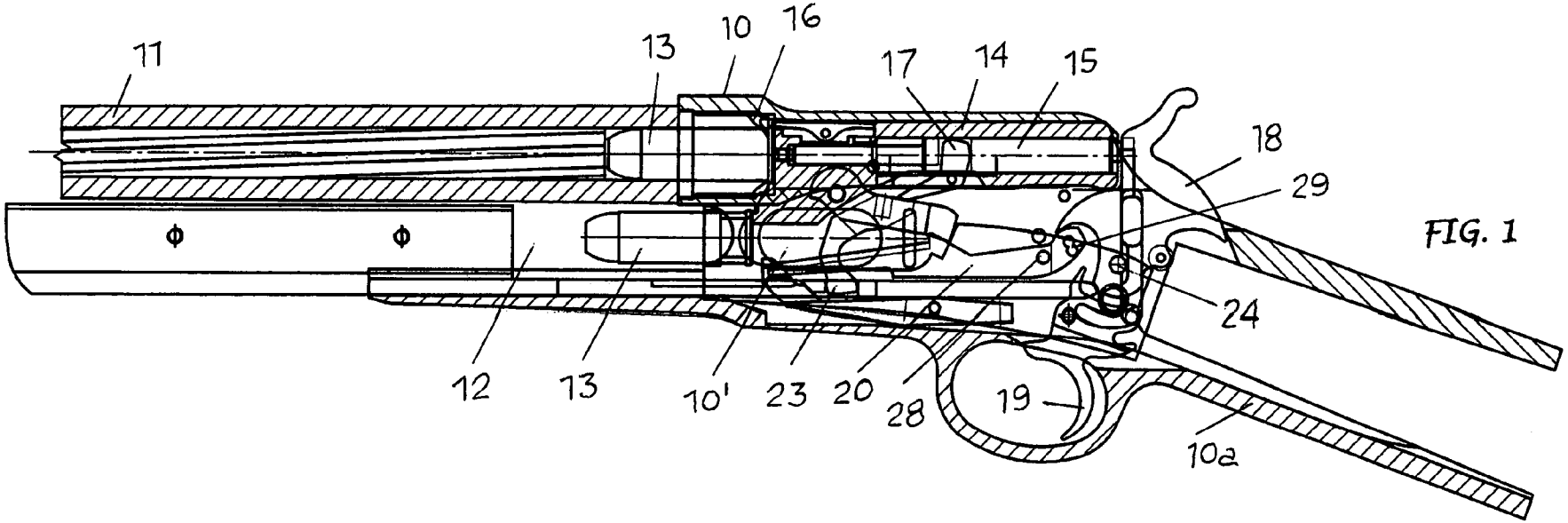
FIG. 1 shows a gun with the hammer released in the firing position of a cartridge in the barrel cartridge chamber.

As shown, the gun comprises a receiver 10 which holds a cocking and firing mechanism and to which are fixed a barrel 11 with cartridge chamber and a magazine tube12, located under and parallel to the barrel and made to contain several cartridges 13 inserted through an opening 10' provided in one side of the receiver.

Said firing mechanism comprises: a breech block 14 holding a firing pin 15, an extractor 16 and a firing pin stop 17; a hammer 18 with relative control trigger 19; a carrier 20; a stop lever 21; and a cocking slide 22 connected to the breech block by means of an action lock 23, and where the hammer, trigger, carrier and stop lever are assembled on a trigger plate 10*a*associated with the receiver 10.

Figure 12:
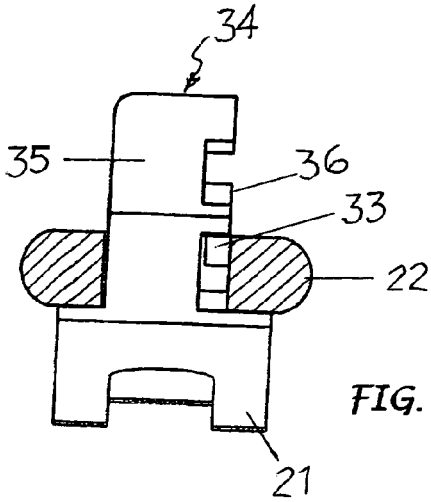
FIGS. 11 and 12 show enlarged cross sections according to arrows A-A and B-B respectively in FIGS. 9 and 10.
Figure 6:
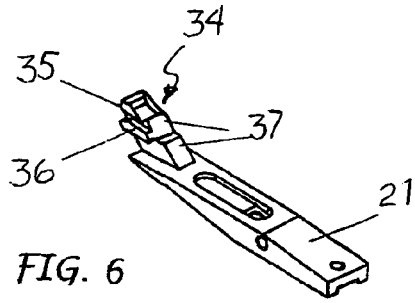
FIG. 6 shows a view only of the stop lever for the cartridge in the magazine.

In detail and considering the barrel as the front of the gun, the breech block 14 moves in line with the barrel between a forward, closing, thrust position of a cartridge 13 into the cartridge chamber of the barrel 11 and a retracted opening position of the cartridge chamber, of expulsion of the fired cartridge shell and cocking of the hammer. The movements of the breech block from one position to the other are set by the cocking slide 22 by means either of the action lock 23 or by hand. When the breech block is in the closed position, said action lock 23 rests against a fixed shoulder stop 10" with the help of a spring 23'—FIG. 12—, which, above all, acting as a safety device, prevents it uncoupling in the cases of either small movements of the cocking slide, or knocks or vibrations received by the gun.

Figure 15:
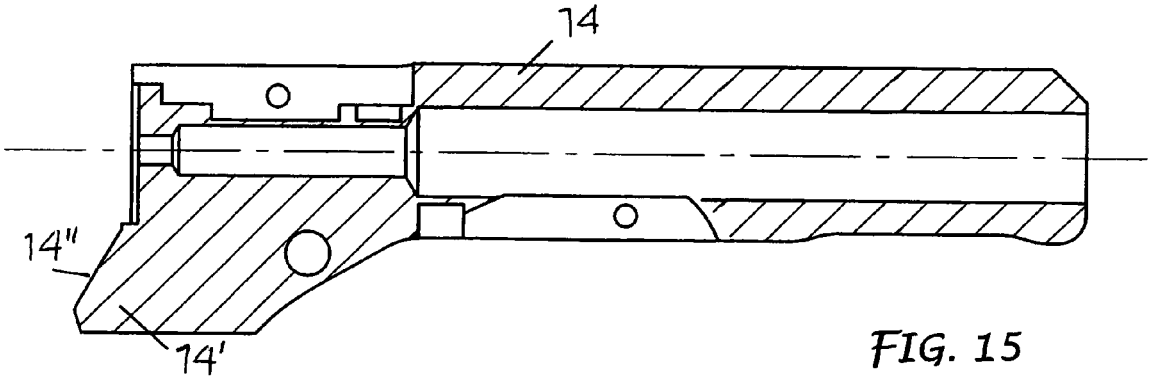
FIG. 15 shows a cross section view of the breech block to highlight the front slide for inserting the cartridge in to the barrel

Also of important is the fact that the breech block has a front appendix 14'—FIG. 15—facing forwards and forming a sloping surface or slide 14" made for a cartridge to rest against, be lifted by and to be pushed into the cartridge chamber of the barrel when the breech block moves forward into the closed position.

The firing pin stop 17 on board the breech block 14 is provided to hold the firing pin in a retracted inactive position until the breech block is in a forward position and the firing pin has to be hit by the hammer in order to fire a cartridge present in the barrel cartridge chamber.

The hammer 18 can turn on an axis 24 between an active position on the firing pin and a cocking position, in which it is stopped by a latch 25 integral with the control trigger 19 and engaging with a cocking tooth 26 of the hammer.

Figure 14:
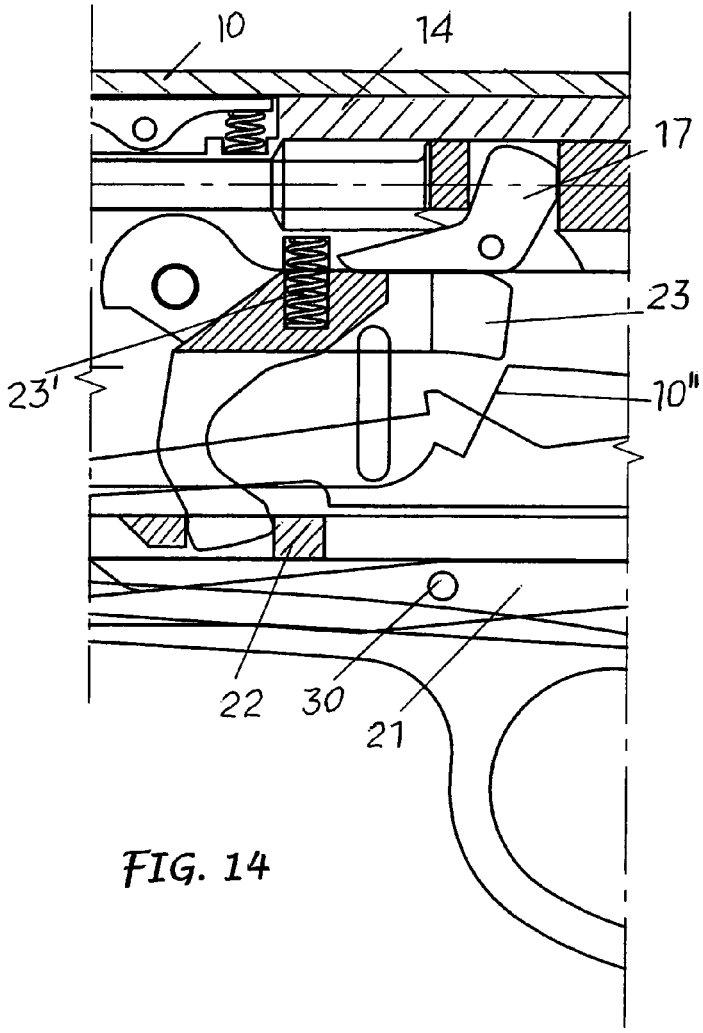
FIG. 14 shows in detail the locking means of the carrier in its lowered and raised positions.
Figure 13:
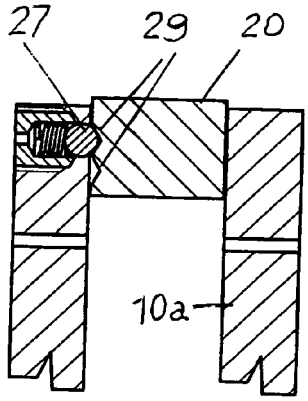
FIG. 13 shows in detail a spring positioned between the breech block and action lock.

The carrier 20 oscillates on a pin 28 and is moved by the breech block action lock 23 and in relation to the position of the hammer 18 between a lowered position to receive a cartridge 13 from the cartridge magazine 12 and a raised position to guide the cartridge towards the cartridge chamber of the barrel 11. When the breech block is forward, the carrier 20 is in the lowered position on a level with the exit of the magazine 12; when, on the other hand, the breech block is retracted to cock the hammer, the carrier 20 is moved into the raised position. The carrier 20 has two lateral indents 29 which engage alternately with a locking means, such as a ball spring 27 or something similar—FIG. 14, to temporarily hold the carrier in one or the other of its two positions, lowered or raised.

The stop lever 21 is assembled on a respective pin 30 carried by the trigger plate 10*a* to be longitudinally stationary, but rocking on said pin between an intercepting, working position of a first cartridge in the magazine 12 and an inoperative release position of the same cartridge from the magazine. This stop lever 21 is positioned below the carrier 20 and is associated and interacting with the cocking slide 22. The latter is guided in the receiver 10 and manually movable along the cartridge magazine 12 between a forward rest position, in which the breech block is in the forward closed position, and a retracted work position, in which it moves the breech block back, causing the hammer to move into the cocked position and the carrier 20 to lift up.

At its rear, free end, the cocking slide has a slot 31 by means of which it engages with the action lock 23 associated with the breech block 14 and made to block the latter in the closed position of the cartridge magazine.

The cocking slide 22 has also a longitudinal slot 32 with two ribs 33 on an intermediate part of the length of the opposite sides, into which a stop protrusion 34 integral with the end facing forwards of the stop lever 21, fits and is guided. Said stop protrusion 34 has a front surface 35 facing towards the cartridge magazine, two wings 36 on its sides and two sloping surfaces 37 on its rear side.

The stop lever 21 is stressed by two, different strength, flat springs; a first spring 38, the weaker, placed between the trigger plate 10*a* and the latch and tending to move the latter upwards into a working position; a second spring 39, the stronger, positioned between the stop lever and the cocking slide 22. The latter spring 39 is present only to come into contact with the rear part of the cocking slide 22 when the latter is moved forward, so as to annul the action of the first spring 38 and allow the protrusion 34 of the stop lever 21 to lower into an inoperative position. The spring 39 is on the other hand unimportant when it is in line with the slot 32 of the cocking slide 22.

The front surface 35 of the stop protrusion 34 is made to stop and hold the cartridges in the magazine; the lateral wings 36 are provided to interact with the ribs 33 on the sides of the slot of the cocking slide 22 so as to move the protrusion 34 of the cartridge stop lever 21 higher; the sloping surfaces 37 behind the protrusion are there to interact with a shoulder 40, also inclined, formed on a cross-piece near the rear end of the longitudinal slot 32 and separating the latter from slot 31 connecting the cocking slide 22 to the action lock lever 23.

Figure 2:
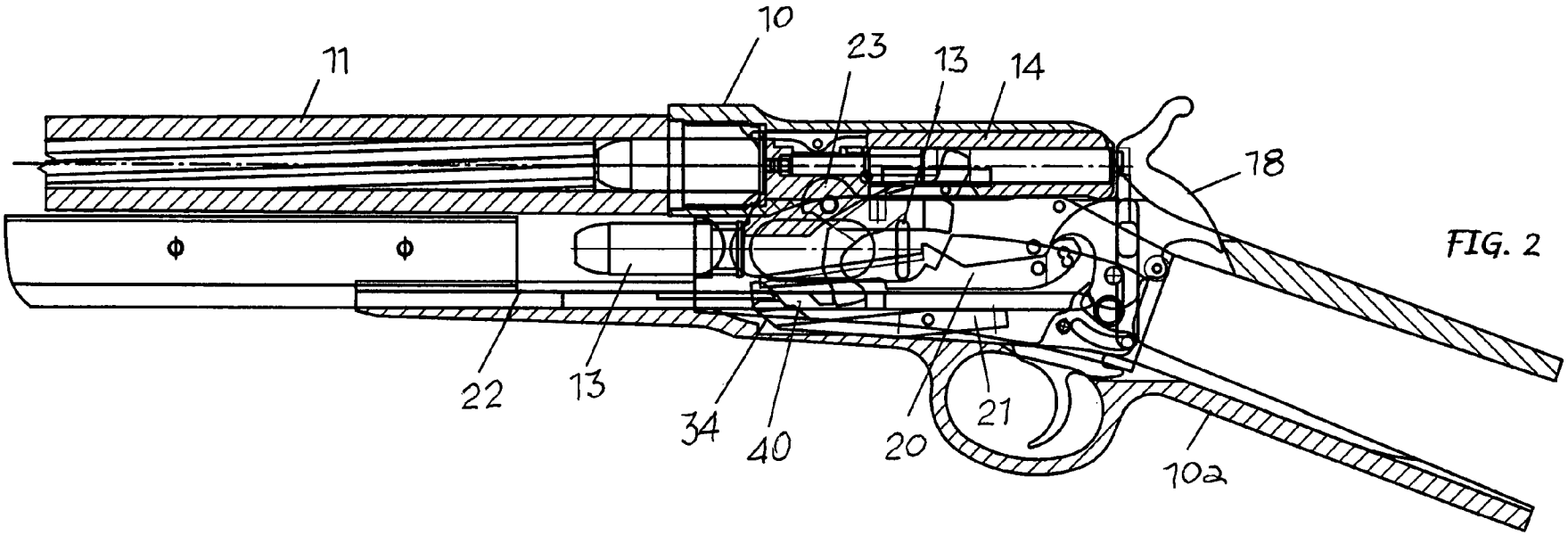
FIG. 2 shows the gun at the start of the retraction movement of the cocking slide and breech block.

When the cocking slide 22 is in the forward rest position and the breech block 14 is in the closed position of the cartridge chamber, and thanks to the second spring 39, the protrusion 34 of the cartridge stop lever 21, is lowered without intercepting the first cartridge in the magazine, by means of the inclined shoulder 40 which engages the inclined surfaces 37 at the rear of the stop protrusion 34. In this position, the carrier 20 is in a lowered position and can receive a cartridge from the magazine and if the hammer has been turned previously in the cocked position it is possible to release it to fire a cartridge present in the barrel—FIGS. 1 and 2.

Figure 3:
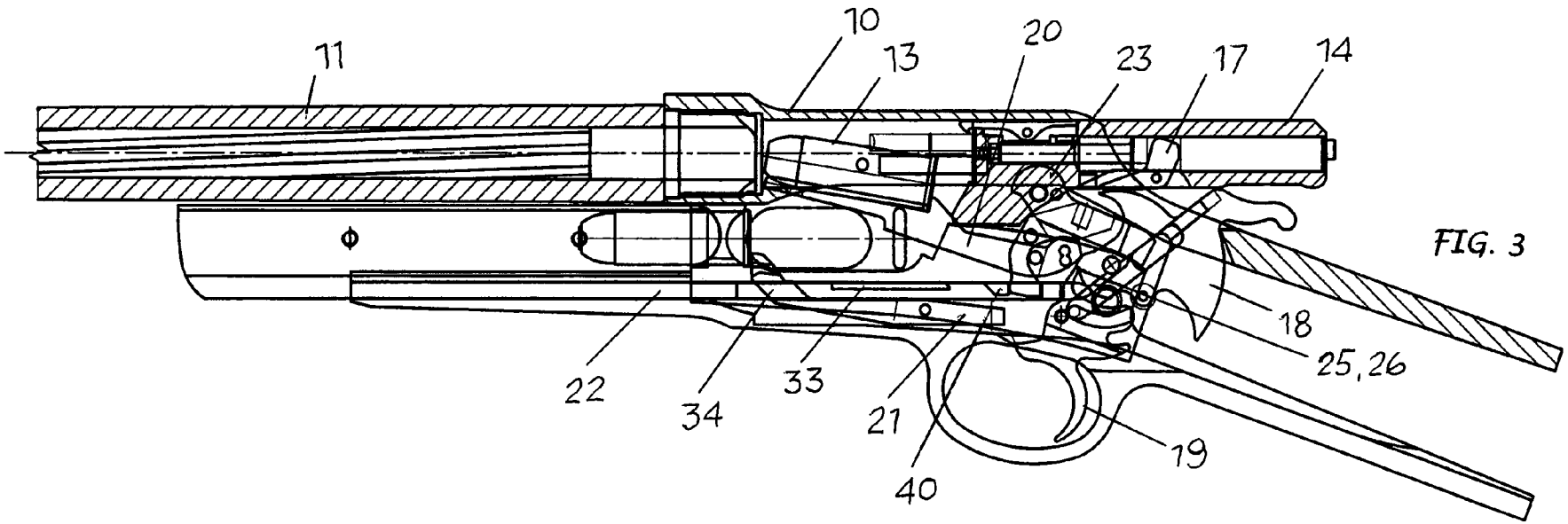
FIG. 3 shows and intermediate step of the retraction movement of the cocking slide.
Figure 4:
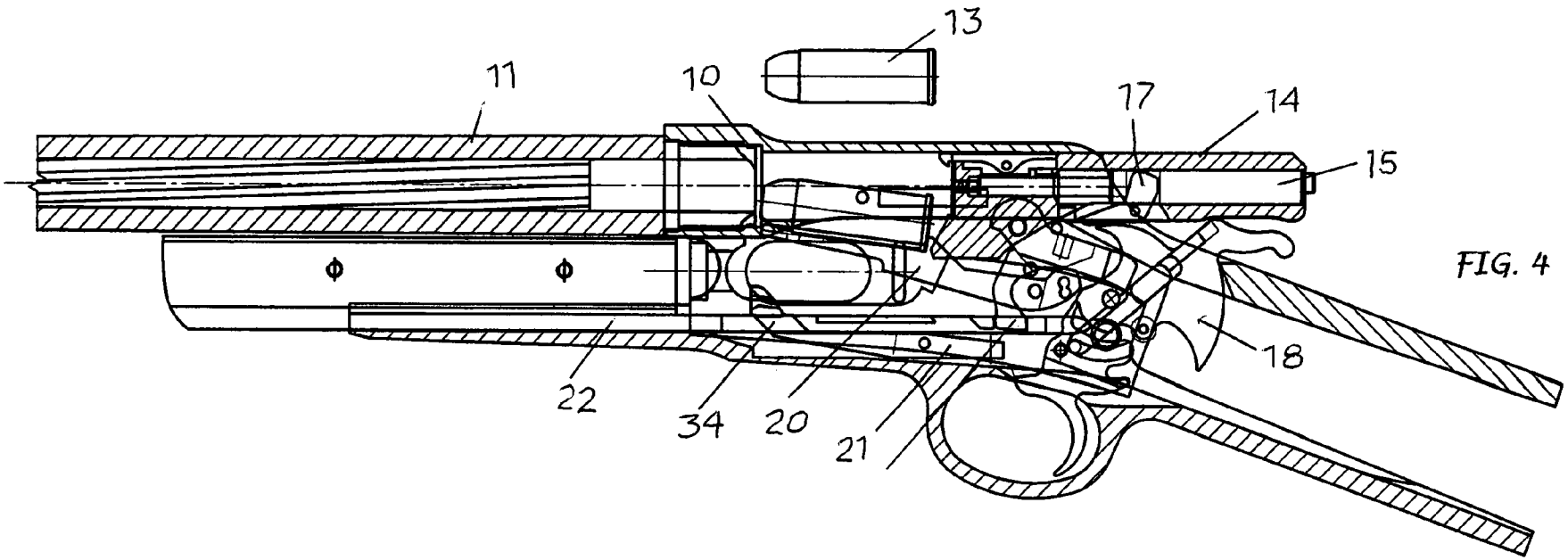
FIG. 4 shows the gun in the expulsion step of a fired cartridge, of stopping of a cartridge in the magazine and cocking of the hammer.
Figure 8:
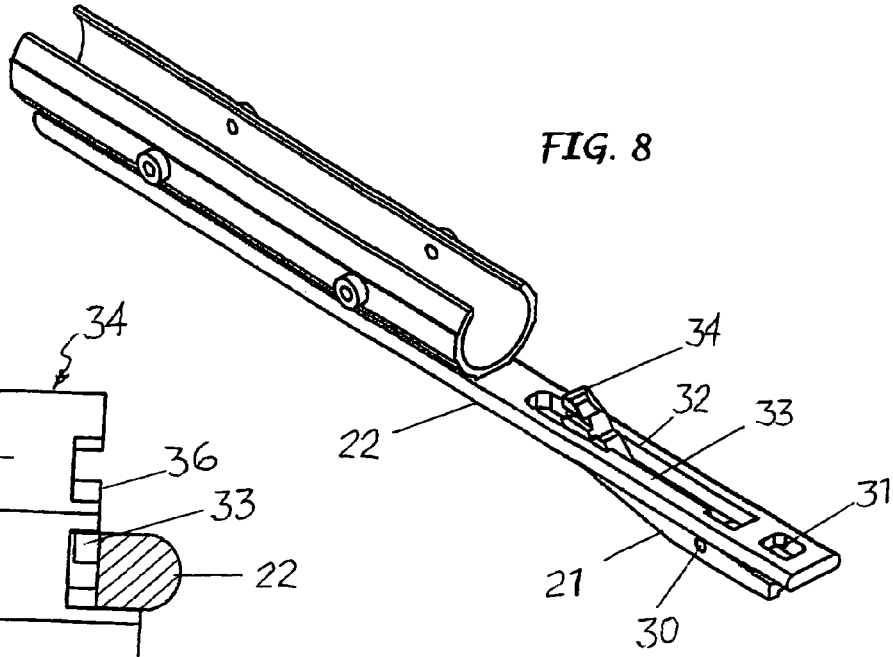
FIGS. 7 and 8 show the stop lever in combination with the cocking slide in the two extreme positions, respectively with the slide in the forward and retracted positions.
Figure 7:
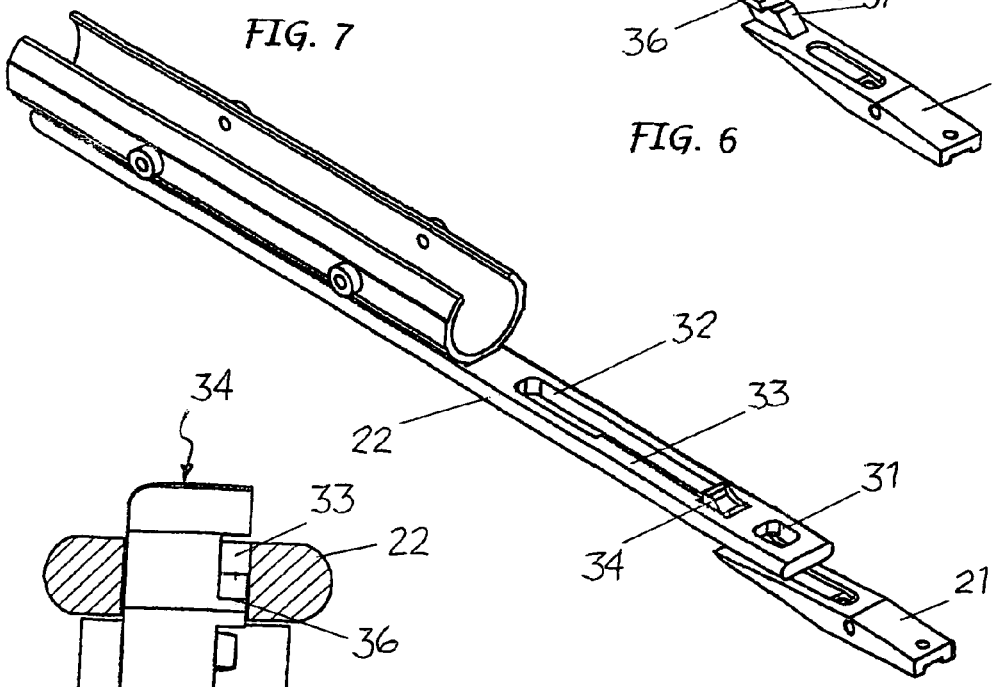
Figure 11:
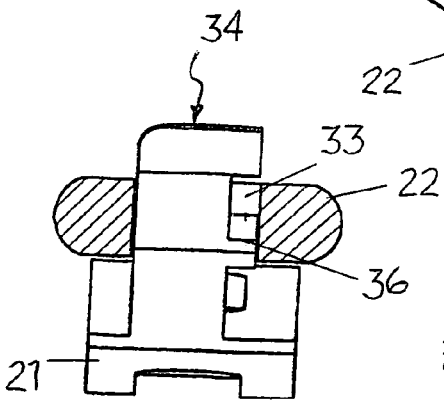
Figure 9:
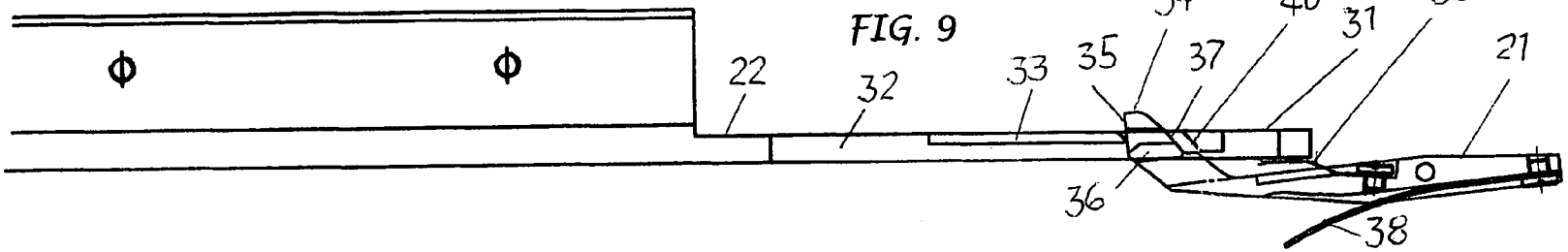
FIGS. 9 and 10 show side views of the combination in FIG. 7 and in FIG. 8, respectively.
Figure 10:
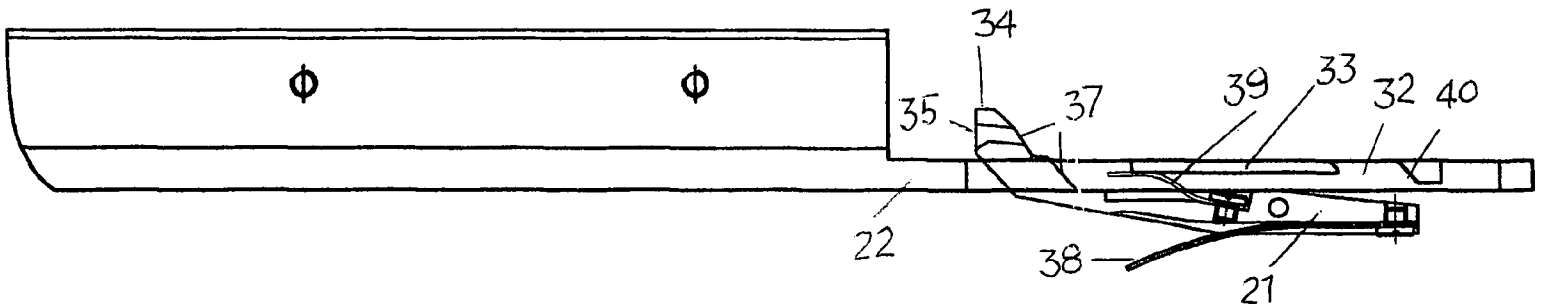

The stop lever 21, thrust by the first spring 38, is on the other hand raised into the operating position, with the protrusion 34 protruding over the cocking slide 22, when this cocking slide is fully retracted in the breech block 14 retracted position to open the cartridge chamber and to re-arm the hammer. So, the stop protrusion 34 with its front surface 35 intercepts and holds the cartridges in the magazine 12—FIG.3. In a first section of the backwards movement of the cocking slide 22, however, the action of the spring 39 ceases, but the stop lever 21 still remains lowered due to the lateral ribs 33—FIGS. 7-9—in the slot of the clocking slide that rest and slide on the wings 36 on the sides of the stop protrusion 34 until the latter comes into contact with the cartridge of the carrier. Only in the last portion of the backward movement of the cocking slide 22 does the stop lever 21 move into the interception position of the cartridge 13 in magazine 12—FIGS. 3, 4. In this way, in fact, the lateral ribs 33 disengage the lateral wings 36 of the stop protrusion 34—FIGS. 8, 10—and the spring 38 makes the stop lever oscillate until its protrusion 34 intercepts and holds the cartridge in the tank. At the same time the carrier 20, engaged by the action lock 23, will lift the cartridge 13 received on a level with the barrel, and the cartridge will be thrust and closed in the cartridge chamber following the successive manual forward movement of the cocking slide and consequent forward movement of the breech block in the closed position—FIG. 1, with the cartridge stop lever 21 lowered in the idle position and with the gun ready to fire again.

Figure 5:
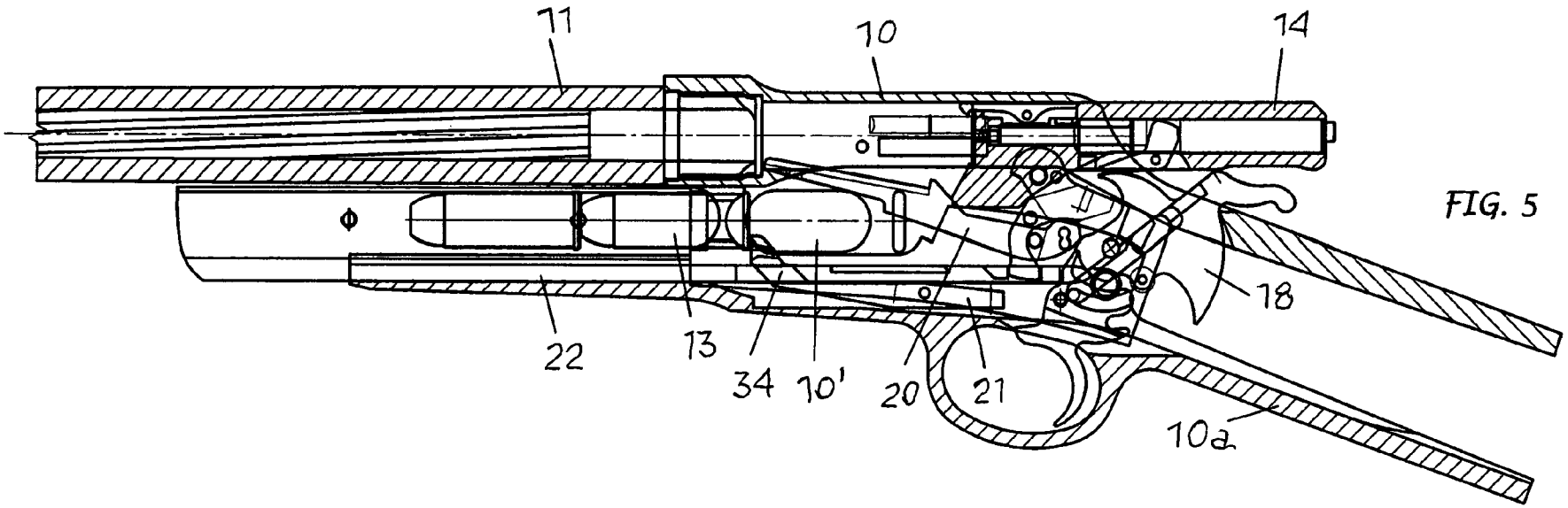
FIG. 5 shows the gun in a step of discharging of cartridge from the magazine without actuating the hammer.

To discharge the cartridges from the magazine without firing them, simply cock the hammer—FIG. 5—and move the cocking slide backwards and forwards without ever having to release the hammer until all the cartridges have been expelled.

The invention claimed is:

1. A pump gun comprising:

a barrel with a cartridge chamber;

a cartridge magazine tube arranged under and parallel to the barrel;

a carrier receiving a cartridge from the magazine tube, said carrier transferring the cartridge to the barrel cartridge chamber;

a breech block moving between a retracted open position and a forward closed position of the cartridge chamber;

a firing pin located on said breech block;

a hammer associated with a control trigger, said hammer turning between a cocked and a firing position, said hammer contacting said firing pin in said firing position;

a retaining lever maintaining said firing pin in a retracted position;

a cocking slide moving between a forward rest position and a retracted work position, said cocking slide producing the movements of the breech block, the rotation of the hammer in the cocked position and transfer of a cartridge from the magazine to the carrier to send the cartridge to the barrel cartridge chamber following a successive forward movement of the breech block;

a closing lever associated with the cocking slide, said closing lever locking the breech block in the forward closed position of the barrel cartridge chamber when the cocking slide is in the forward position; and a longitudinally stationary cartridge stop lever, engaging with said cocking slide, said stop lever mounted on an intermediate pin and moving between an operating interception position of a first cartridge in the magazine tube, when the cocking slide is in the retracted position, and an idle release position of the same cartridge from the magazine tube, when the cocking slide is in the forward position, said cocking slide having a rear slot engaging an action lock lever, said cocking slide having a longitudinal slot provided with two ribs on an intermediate part of the length of its opposite sides and with an inclined shoulder at a rear end of said slot, wherein the intermediate pin of the cartridge stop lever is mounted on a trigger plate, and wherein said stop lever has a front end with a stop protrusion extending through said longitudinal slot and having a front surface facing towards the cartridge magazine, said stop lever having two wings on its sides and two sloping surfaces on a rear side, the stop protrusion intercepting and holding the cartridges in the magazine when said stop lever is in the operating position, the lateral wings of said stop protrusion interacting with the ribs on the sides of the longitudinal slot of the cocking slide to move said stop lever with the stop protrusion in the idle release position during the movements of said cocking slide between the forward and retracted positions, and said inclined surfaces interacting with said shoulder at the rear end of the cocking slide slot to maintain said stop lever with protrusion in the idle position when the cocking slide is in the forward position.

2. A gun according to claim 1, wherein said cartridge stop lever is stressed by a first spring such that said lever with the protrusion moves into the operating position when the cocking slide is retracted and by a second spring opposite said first spring and coming into action only with the rear end of the cocking slide to annul the action of the first spring and hold the stop lever with protrusion in the idle position when the cocking slide is in the forward position, the first spring operating with a different strength, with the first spring weaker than the second.

3. A gun according to claim 1, wherein the action lock lever is stressed by a spring such that said action lock lever is held in the operating closed breech block position, said spring being placed between the breech block and the lever itself.

4. A gun according to claim 3, wherein the breech block has an appendix at the front facing forwards and forming an inclined surface made to lift and push a cartridge into the cartridge chamber of the barrel.

5. A gun according to claim 3, wherein the carrier is disconnected from the hammer and interacts with the action lock lever for moving the carrier between the lowered and raised positions, and wherein on one side of said carrier two indents are provided which engage alternately with a stop spring means to temporarily hold the carrier in one and the other of said lowered and raised positions.

6. A pump gun comprising:

a barrel with a cartridge chamber;

a cartridge magazine tube arranged under and parallel to the barrel;

a carrier receiving a cartridge from the magazine tube, said carrier transferring the cartridge to the barrel cartridge chamber;

a breech block moving between a retracted open position and a forward closed position of the cartridge chamber;

a firing pin located on said breech block;

a hammer associated with a control trigger, said hammer turning between a cocked and a firing position, said hammer contacting said firing pin in said firing position;

a retaining lever maintaining said firing pin in a retracted position;

a cocking slide moving between a forward rest position and a retracted work position, said cocking slide producing the movements of the breech block, the rotation of the hammer in the cocked position and transfer of a cartridge from the magazine to the carrier to send the cartridge to the barrel cartridge chamber following a successive forward movement of the breech block;

a closing lever associated with the cocking slide, said closing lever locking the breech block in the forward closed position of the barrel cartridge chamber when the cocking slide is in the forward position; and a longitudinally stationary cartridge stop lever, interacting with said cocking slide, said stop lever mounted on an intermediate pin, said stop lever moving between an operating interception position of a first cartridge in the magazine tube, when the cocking slide is in the retracted position, and an idle release position of the same cartridge from the magazine tube, when the cocking slide is in the forward position, said cocking slide having a rear slot interacting with an action lock lever, said cocking slide having a longitudinal slot provided with two ribs on an intermediate part of the length of its opposite sides and with an inclined shoulder at a rear end of said slot, wherein the intermediate pin of the cartridge stop lever is mounted on a trigger plate, and wherein said stop lever has a front end with a stop protrusion extending through said longitudinal slot and having a front surface facing towards the cartridge magazine, said stop lever having two wings on its sides and two sloping surfaces on a rear side, the stop protrusion intercepting and holding the cartridges in the magazine when said stop lever is in the operating position, the lateral wings of said stop protrusion interacting with the ribs on the sides of the longitudinal slot of the cocking slide to move said stop lever with the stop protrusion in the idle release position during the movements of said cocking slide between the forward and retracted positions, and said inclined surfaces interacting with said shoulder at the rear end of the cocking slide slot to maintain said stop lever with protrusion in the idle position when the cocking slide is in the forward position, said cartridge stop lever being stressed by a first spring such that said lever with the stop protrusion moves into the operating position when the cocking slide is retracted, said cartridge stop lever being tensioned by a second spring opposite said first spring, said second spring contacting the rear end of the cocking slide to annul the action of the first spring, said second spring holding the stop lever with stop protrusion in the idle position when the cocking slide is in the forward position, said first spring operating with a different strength, said first spring having a strength weaker than said second spring.

7. A pump gun comprising:

a barrel with a cartridge chamber;

a cartridge magazine tube arranged under and parallel to the barrel;

a carrier receiving a cartridge from the magazine tube, said carrier transferring the cartridge to the barrel cartridge chamber;

a breech block moving between a retracted open position and a forward closed position of the cartridge chamber;

a firing pin located on said breech block;

a hammer associated with a control trigger, said hammer turning between a cocked and a firing position, said hammer contacting said firing pin in said firing position;

a retaining lever maintaining said firing pin in a retracted position;

a cocking slide moving between a forward rest position and a retracted work position, said cocking slide producing the movements of the breech block, the rotation of the hammer in the cocked position and transfer of a cartridge from the magazine to the carrier to send the cartridge to the barrel cartridge chamber following a successive forward movement of the breech block;

a closing lever associated with the cocking slide, said closing lever locking the breech block in the forward closed position of the barrel cartridge chamber when the cocking slide is in the forward position; and a longitudinally stationary cartridge stop lever, interacting with said cocking slide, said stop lever mounted on an intermediate pin and moving between an operating interception position of a first cartridge in the magazine tube, when the cocking slide is in the retracted position, and an idle release position of the same cartridge from the magazine tube, when the cocking slide is in the forward position, said cocking slide having a rear slot interacting with an action lock lever, said cocking slide having a longitudinal slot provided with two ribs on an intermediate part of the length of its opposite sides and with an inclined shoulder at a rear end of said slot, wherein the intermediate pin of the cartridge stop lever is mounted on a trigger plate, and wherein said stop lever has a front end with a stop protrusion extending through said longitudinal slot and having a front surface facing towards the cartridge magazine, said stop lever having two wings on its sides and two sloping surfaces on a rear side, the stop protrusion intercepting and holding the cartridges in the magazine when said stop lever is in the operating position, the lateral wings of said stop protrusion interacting with the ribs on the sides of the longitudinal slot of the cocking slide to move said stop lever with the stop protrusion in the idle release position during the movements of said cocking slide between the forward and retracted positions, and said inclined surfaces interacting with said shoulder at the rear end of the cocking slide slot to maintain said stop lever with protrusion in the idle position when the cocking slide is in the forward position, said action lock lever being stressed by a spring such that said action lock lever is held in the operating closed breech block position, said spring being located between the breech block and the action lock lever.

8. A pump gun comprising:

a barrel with a cartridge chamber;

a cartridge magazine tube arranged under and parallel to the barrel;

a carrier receiving a cartridge from the magazine tube, said carrier transferring the cartridge to the barrel cartridge chamber;

a breech block moving between a retracted open position and a forward closed position of the cartridge chamber;

a firing pin located on said breech block;

a hammer associated with a control trigger, said hammer turning between a cocked and a firing position, said hammer contacting said firing pin in said firing position;

a retaining lever maintaining said firing pin in a retracted position;

a cocking slide moving between a forward rest position and a retracted work position, said cocking slide producing the movements of the breech block, the rotation of the hammer in the cocked position and transfer of a cartridge from the magazine to the carrier to send the cartridge to the barrel cartridge chamber following a successive forward movement of the breech block;

a closing lever associated with the cocking slide, said closing lever locking the breech block in the forward closed position of the barrel cartridge chamber when the cocking slide is in the forward position; and a longitudinally stationary cartridge stop lever, interacting with said cocking slide, said stop lever mounted on an intermediate pin and moving between an operating interception position of a first cartridge in the magazine tube, when the cocking slide is in the retracted position, and an idle release position of the same cartridge from the magazine tube, when the cocking slide is in the forward position, said cocking slide having a rear slot interacting with an action lock lever, said cocking slide having a longitudinal slot provided with two ribs on an intermediate part of the length of its opposite sides and with an inclined shoulder at a rear end of said slot, wherein the intermediate pin of the cartridge stop lever is mounted on a trigger plate, and wherein said stop lever has a front end with a stop protrusion extending through said longitudinal slot and having a front surface facing towards the cartridge magazine, said stop lever having two wings on its sides and two sloping surfaces on a rear side, the stop protrusion intercepting and holding the cartridges in the magazine when said stop lever is in the operating position, the lateral wings of said stop protrusion interacting with the ribs on the sides of the longitudinal slot of the cocking slide to move said stop lever with the stop protrusion in the idle release position during the movements of said cocking slide between the forward and retracted positions, and said inclined surfaces interacting with said shoulder at the rear end of the cocking slide slot to maintain said stop lever with protrusion in the idle position when the cocking slide is in the forward position, said action lock lever being stressed by a spring such that said action lock lever is held in the operating closed breech block position, said spring being located between the breech block and the action lock lever, said breech block having an appendix at the front facing forwards and forming an inclined surface to lift and push a cartridge into the cartridge chamber of the barrel.

9. A pump gun comprising:

a barrel with a cartridge chamber;

a cartridge magazine tube arranged under and parallel to the barrel;

a carrier receiving a cartridge from the magazine tube, said carrier transferring the cartridge to the barrel cartridge chamber;

a breech block moving between a retracted open position and a forward closed position of the cartridge chamber;

a firing pin located on said breech block;

a hammer associated with a control trigger, said hammer turning between a cocked and a firing position, said hammer contacting said firing pin in said firing position;

a retaining lever maintaining said firing pin in a retracted position;

a cocking slide moving between a forward rest position and a retracted work position, said cocking slide producing the movements of the breech block, the rotation of the hammer in the cocked position and transfer of a cartridge from the magazine to the carrier to send the cartridge to the barrel cartridge chamber following a successive forward movement of the breech block;

a closing lever associated with the cocking slide, said closing lever locking the breech block in the forward closed position of the barrel cartridge chamber when the cocking slide is in the forward position; and a longitudinally stationary cartridge stop lever, interacting with said cocking slide, said stop lever mounted on an intermediate pin and moving between an operating interception position of a first cartridge in the magazine tube, when the cocking slide is in the retracted position, and an idle release position of the same cartridge from the magazine tube, when the cocking slide is in the forward position, said cocking slide having a rear slot interacting with an action lock lever, said cocking slide having a longitudinal slot provided with two ribs on an intermediate part of the length of its opposite sides and with an inclined shoulder at a rear end of said slot, wherein the intermediate pin of the cartridge stop lever is mounted on a trigger plate, and wherein said stop lever has a front end with a stop protrusion extending through said longitudinal slot and having a front surface facing towards the cartridge magazine, said stop lever having two wings on its sides and two sloping surfaces on a rear side, the stop protrusion intercepting and holding the cartridges in the magazine when said stop lever is in the operating position, the lateral wings of said stop protrusion interacting with the ribs on the sides of the longitudinal slot of the cocking slide to move said stop lever with the stop protrusion in the idle release position during the movements of said cocking slide between the forward and retracted positions, and said inclined surfaces interacting with said shoulder at the rear end of the cocking slide slot to maintain said stop lever with protrusion in the idle position when the cocking slide is in the forward position, said action lock lever being stressed by a spring such that said action lock lever is held in the operating closed breech block position, said spring being located between the breech block and the action lock lever, said carrier being disconnected from the hammer, said carrier engaging said action lock lever for moving said carrier between the lowered and raised positions, and wherein one side of said carrier having two indents, said two indents engaging alternately with a stop spring means to temporarily hold the carrier in one and the other of said lowered and raised positions.

* * * * *